US005810349A

United States Patent [19]

Bloser et al.

[11] Patent Number: 5,810,349

[45] Date of Patent: Sep. 22, 1998

[54] APPARATUS FOR STACKING SHEET PRODUCTS AT AN OFFSET FROM ONE ANOTHER

[75] Inventors: Helmut Bloser, Lonsee; Gerhard Glemser, Stuttgart; Juergen Ries, Ostfildern, all of Germany

[73] Assignee: Eastman Kodak Company, Rochester, N.Y.

[21] Appl. No.: 782,023

[22] Filed: Jan. 7, 1997

[30] Foreign Application Priority Data

Jan. 11, 1996 [DE] Germany ..... 196 00 777.1

[51] Int. Cl.[6] ..... B65H 31/04

[52] U.S. Cl. ..... 271/213; 271/214; 271/220; 271/223

[58] Field of Search ..... 271/295, 213, 271/214, 215, 217, 220, 224, 223

[56] References Cited

U.S. PATENT DOCUMENTS

| | | | |
|---|---|---|---|
| 3,601,396 | 8/1971 | Robin | 271/213 |
| 4,060,231 | 11/1977 | Stobb et al. . | |
| 4,354,787 | 10/1982 | Gensike et al. | 271/217 |
| 5,037,081 | 8/1991 | Engelhardt et al. | 271/213 |
| 5,108,082 | 4/1992 | Shea et al. . | |
| 5,267,793 | 12/1993 | Hawitt . | |

FOREIGN PATENT DOCUMENTS

| | | | |
|---|---|---|---|
| 0282161 | 11/1990 | Japan | 271/220 |
| 403166132A | 7/1991 | Japan | 271/213 |

*Primary Examiner*—H. Grant Skaggs
*Attorney, Agent, or Firm*—Lawrence P. Kessler

[57] ABSTRACT

An apparatus (1) for depositing sheet products (39, 40) at an offset has a deposition tray (2) that can be rotated alternately by 180 degrees in opposite directions about a vertical axis (41), and is equipped with a vertically movable deposition table (34). Delimiters (19, 20), arranged symmetrically to the rotation axis (41) and parallel to one another, and extending transverse to transport direction A of the sheet products (39, 40), are provided above a top starting position of the deposition table (34). Associated with each of the delimiters (19 or 20) are pivotedly arranged holding elements (17, 33 or 18, 32), which can be placed on the sheet products (39, 40) deposited on the deposition table (34). The delimiters (19 or 20) and the associated holding elements (17, 33 or 18, 32) are each configured as horizontally displaceable assemblies (21, 22). The delimiters (19 and 20) are adjusted to a distance from the rotation axis (41) that is greater, with respect to the transport direction (A), that half the width of the sheet product (39, 40). During deposition of the sheet products (39, 40), which occurs at an acute angle ($\alpha$) as far as the respective delimiter (19 or 20) serving as the stop, deposition at an offset to one another by an amount (x) in each case is achieved by the alternating 180-degree rotation of the deposition tray.

21 Claims, 3 Drawing Sheets

APPARATUS FOR STACKING SHEET PRODUCTS AT AN OFFSET FROM ONE ANOTHER

BACKGROUND OF THE INVENTION

The invention relates to an apparatus for stacking sheet products one above another, with a deposition tray which is rotatable, for purposes of stack compensation, about a vertical axis, which has a vertically movable deposition table and is equipped with two opposing vertically arranged delimiters, associated with which are holding elements which retain the deposited stack of sheet products during rotation of the deposition tray and in which the sheet products are deposited with their thicker end adjacent to one of the opposing delimiters.

Apparatus of this type are used, with sheet products that because of a varying thickness become increasingly skewed when stacked one above another, to achieve a stable stack structure by alternating deposition.

For this purpose it is known (EP-PS 0 167 704) to deliver small stacks of sheet products into a rotatable deposition tray and to rotate the deposition tray alternately; or individual sheet products, prior to stacking, are deposited by turning elements (DE-OS 27 42 983) in an orientation such that their folds are located on opposing sides of the stack. Retaining a deposited stack during rotation has also been made known by EP-PS 0 167 704. The deposition capacity of the known elements is limited, however, by the fact that the thicker folded regions substantially increase the stack height.

SUMMARY OF THE INVENTION

It is the object of the invention to configure a deposition element in such a way that it allows a greater deposition capacity together with a stable stack structure.

In accordance with the invention, this object is attained in that;

the deposition tray can rotate alternately by 180 degrees in such a way that in each case one of the opposing delimiters of the deposition tray is arranged in the deposition path of the respective sheet product, and serves as the stop surface for it;

the distance between the delimiters and the rotation axis of the deposition tray, with respect to the transport direction of the sheet products to be deposited, is greater than half the width dimension of the sheet product, so that when the deposition tray rotates alternately, the successively deposited sheet products are deposited offset from one another by an amount;

the holding elements are configured to be movable out of the deposition path of the sheet products, and can be placed alternately on the top of a deposited sheet product; and the holding elements are associated with the region of the deposited sheet product adjacent to the respective delimiter that remains uncovered, due to the offset deposition, in terms of the sheet product to be deposited next.

According to the invention, the increase in deposition capacity is achieved by a method characterized in that;

the delimiters of the deposition tray are adjusted to a distance from the rotation axis of the deposition tray which is greater than half the width dimension of the sheet product;

the sheet product to be deposited enters the deposition tray on a deposition path to the delimiters extending at an acute angle, and strikes with its thicker end against the delimiter of the deposition tray that is arranged in the deposition path and serves as a stop;

the deposition tray is alternately rotated by 180 degrees so that the sheet products alternately striking one of the delimiters are deposited offset by an amount from one another; and after the respective deposition procedure, the associated holding element presses on the stack in the region of the sheet product which remains uncovered by the amount in terms of the sheet product to be deposited next.

In an advantageous modification of the invention, the sheet products are deposited offset from one another to the extent that the region remaining uncovered in terms of the sheet product to be deposited next is at least as great as the greatest thickening of the bound, stitched, and/or folded region. The particularly advantageous result of this offset is that the stack height is determined exclusively by the number of sheets of the sheet products lying flat on top of one another, since the region of the sheet products lying flat on top of one another, which creates a spacing between the thickenings, is always located between two superimposed thickenings.

In a particularly advantageous modification of the invention, the sheet products, especially in the case of folded products, are deposited offset from one another by an amount that is greater than the greatest thickening of the folded region, so that the respective associated holding element can be placed on the folded product closer to the rotation axis of the deposition tray and next to the greatest thickening of the folded region. The advantageous result of this feature is that a deposited folded product that has a tendency to open by itself is reliably closed by the holding element resting farther inward and held in the closed state, so that the succeeding folded product can be deposited without difficulty.

In a preferred modification of the invention, the apparatus can be adjusted to different formats of sheet products to be deposited.

The sheet products are conveyed at an acute angle, by transport and guidance means, against the delimiters serving as stops, so that offset deposition is advantageously achieved in a simple and reliable manner.

Moreover, an advantageous simplification of the apparatus according to the invention is achieved by the fact that the delimiters determining the deposition offset, the holding elements, and the associated conveyance and guidance means, are arranged in a vertically stationary position, and only the deposition table is vertically displaceable by means of a lifting element.

According to the invention, reliable offset deposition is further achieved by the fact that the most recently deposited sheet product and thus the entire stack of sheet products is retained by the holding element until the subsequent sheet product is deposited and retained. The holding element for the subsequent sheet product is located outside the deposition path during the deposition procedure, so that the deposition procedure can easily be performed.

To increase productivity and simplify handling, the deposition table is advantageously mounted detachably on a removal element that can be moved in the manner of a drawer out of the apparatus in a removal position.

The apparatus according to the invention is equally suitable for the deposition of folded products, or sheet products bound along one edge, or adhesive-bound sheet products, or the like.

BRIEF DESCRIPTION OF THE DRAWINGS

Additional features and advantages are evident from the description of an embodiment of the invention depicted in the drawing, and from the subclaims. In the schematic drawings

DETAILED DESCRIPTION OF THE INVENTION

Figure 1:
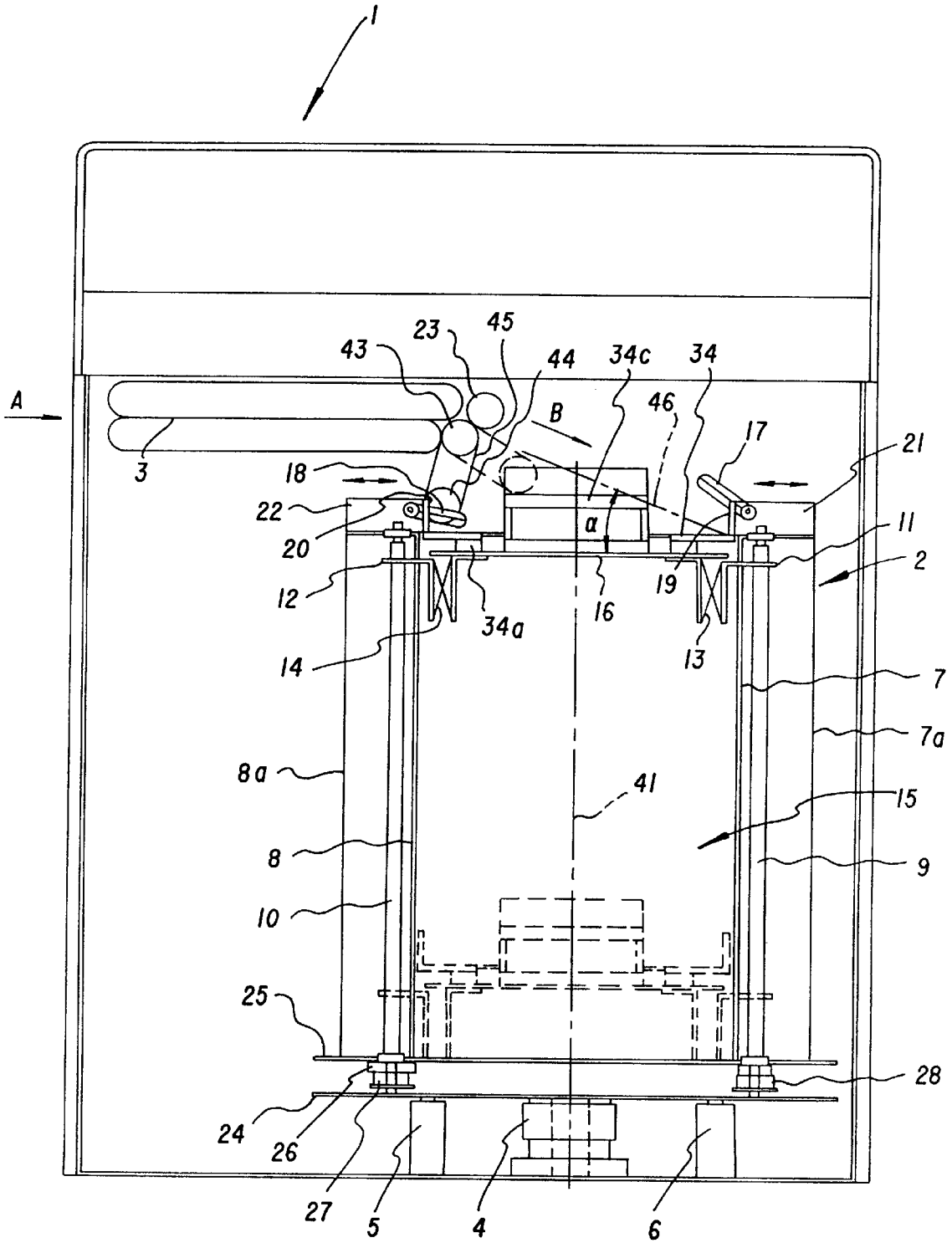
FIG. 1 shows the apparatus in cross-section in a side view.

An embodiment of the apparatus according to the invention, designed as a whole as 1 in FIG. 1, is connected to the output of a downline processing unit (not depicted) from which, for example, bound or unbound folded products 39, 40 are transported into apparatus 1 in the direction of arrow A. The apparatus according to the invention could, however, also be integrated into the hosing of a downline processing unit, for example in accordance with U.S. Pat. No. 5,108,082. The downline processing unit can, for example, be downstream from a copier of known type.

The apparatus according to FIG. 1, configured as a closed unit, has a deposition tray 2, mounted rotatably about a vertical axis 41, in which sheet products 39 or 40 arriving in the direction of arrow A are deposited or stacked one above another in a manner yet to be described.

Deposition tray 2 has interconnected round bas parts 24, 25 that are rotatably mounted on a pivot bearing 4 The underside of lower base part 24 rests on support bearings 5, 6 of known type. In the region of pivot bearing 4, a tension means 38 driven by a motor 29 (see FIG. 2) engages on deposition tray 2.

Inner and outer walls 7, 8 and 7*a*, 8*a* arranged symmetrically with respect to rotation axis 41 are fastened, and four threaded spindles 9, 10, 30 31 are rotatably mounted, on upper base part 25. Fastened to threaded spindles 9, 10, 30, 31 are drive wheels 27, 28 (only two depicted), arranged between base parts 24, 25, which are driven jointly via a tension means 35. A gear 26, into which a motor drive (not depicted) engages, is fastened on one of drive wheels 27.

Guide parts 11 and 12, on each of which an extendible guide rail 13 and 14 is fastened, engage into threaded spindles 9, 30 and 10, 31. A removal element 16 is fastened onto the extendible part of these guide rails 13 and 14.

Figure 2:
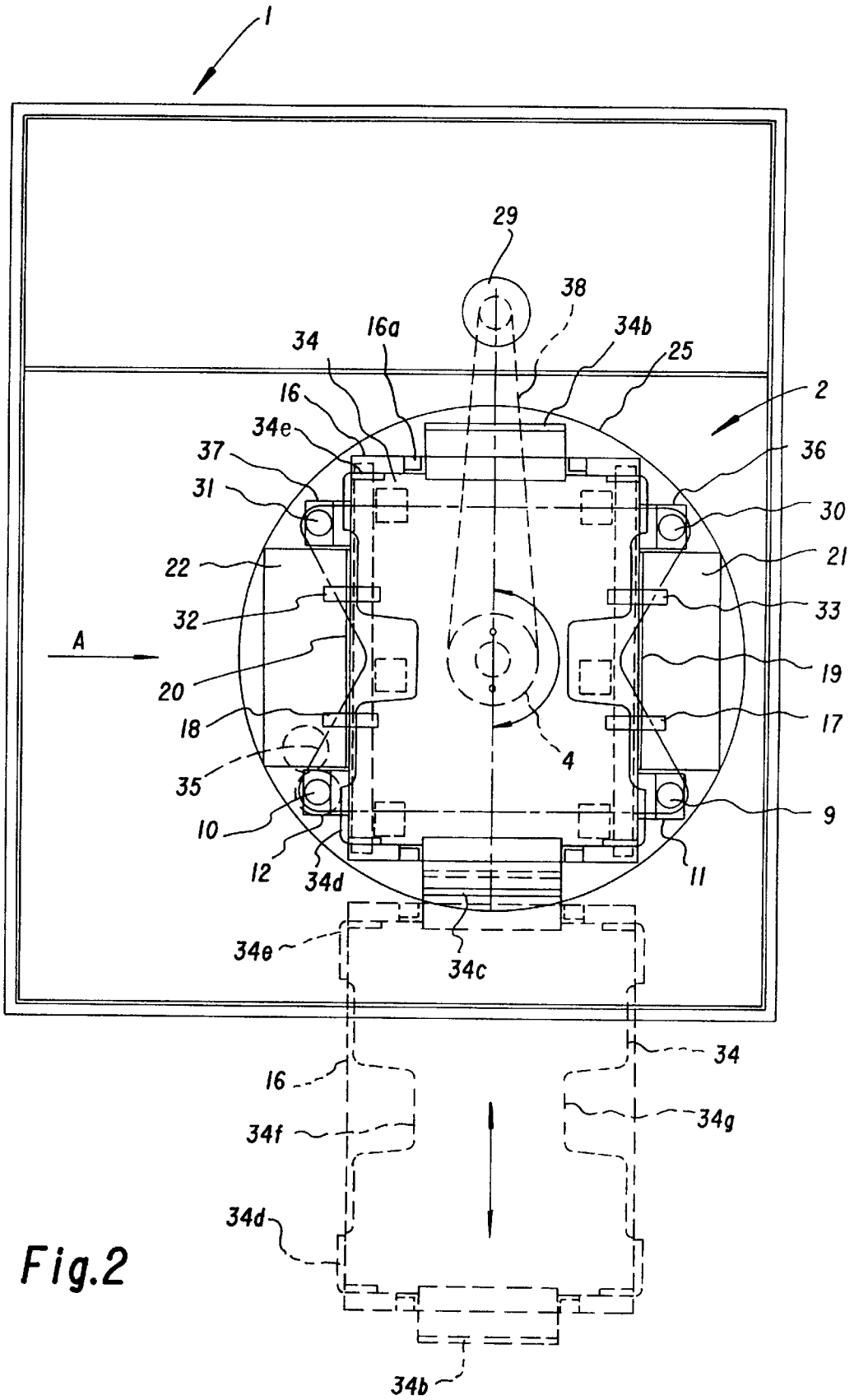
FIG. 2 shows the apparatus of FIG. 1 in a top view, with the upper part of the apparatus omitted.

Arranged on the top of removal element 16, which as indicated in FIG. 2 by dashed lines can be moved into a pulled-out removal position, are four similar projections 16*a*, on which a deposition table 34, resting on four feet 34*a*, is positively immobilized and detachably mounted.

Sheet products 39 or 40 are deposited or stacked, in a manner yet to be described, one on top of another on deposition table 34. Deposition table 34 is equipped at its four comers with similar, angularly shaped wall sections 34*d*, 34*e* which are arranged at a distance from one another that is greater than the maximum spacing that can be set for delimiters 19, 20, yet to be described. Wall sections 34*d*, 34*e* provide slip prevention for a deposited stack 42 of sheet products 39 or 40 when deposition table 34 is lifted off pulled-out removal element 16 by means of two handles 34*b*, 34*c*. Indentations 34*f* and 34*g* on deposition table 34 make it easier to reach under and take out a deposited stack 42 by hand.

Deposition table 34 is arranged, so as to move vertically by means of motor-driven threaded spindles 9, 10, 30, 31 acting as the lifting element, inside a deposition shaft 15 delimited by inner walls 7 and 8 of deposition tray 2.

Arranged at the top end of deposition shaft 15 are two delimiters 19 and 20, arranged parallel to one another, which each form vertically extending stop surfaces facing one another. As is apparent from FIG. 2, delimiters 19 and 20 extend between the respective wall sections 34*d*, 34*e* of deposition table 34, transverse to transport direction A. Delimiters 19 and 20 are part of assemblies 21 and 22, adjustable in transport direction A, that are mounted on walls 7, 7*a* and 8, 8*a*. With deposition table 34 in its top starting position, its deposition surface is delimited by delimiters 19, 20.

Associated with each of delimiters 19 and 20 are two holding elements 17, 33 and 18, 32, which are fastened to assemblies 21 and 22 and adjustable with them in transport direction A. Holding elements 17, 33 and 18, 32 are configured as pivotedly mounted levers that are electromagnetically movable in a known manner (not depicted) in such a way that in a raised starting position (depicted in FIG. 1 for holding element 17) they are arranged outside a deposition path 46 yet to be described, and in a swung-in retaining position (depicted in FIG. 1 for holding element 18), they rest in spring-loaded fashion on a deposited stack 42. Arranged in the pivot region of holding elements 17, 33 and 18, 32 are sensors (not depicted) of known type which, as the stack height increases, control the motor drive of the lifting element as a function of the angular position of holding elements 17, 33 and 18, 32, in order to keep the top of deposited stack 42 at an operationally correct level by lowering.

Assemblies 21, 22—on which, in addition to delimiters 19, 20 and holding elements 17, 18, 32, 33, their electromagnetic drive and the sensors for controlling the level of the lifting element are also fastened—are adjusted manually by means of a pin-and -slot guide and a clamping element of known type (not depicted). Adjustment can, however, also be accomplished automatically under motorized control based (not depicted).

Transport belts 3, a transport roller pair 23, 43, a guide roller 44, and a transport belt 45 guided on transport roller 43 and guide roller 44 are arranged above assemblies 21 and 22. Transport belts 3 pick up a sheet product 39 or 40 delivered from the preceding downline processing unit and transport it in the direction of arrow A to transport rollers 23 and 43, which are arranged so that they convey sheet product 39 or 40 in the direction of arrow B, at an acute angle $\alpha$ to delimiter 19 or 20 located at the end of a deposition path 46 indicated with dot-dash lines.

The apparatus can be used to deposit sheet products 40 or 39 that are long or short when viewed with reference to transport direction A, for example DIN A4 or DIN AS format, sheet products 39 or 40 in each case entering apparatus 1 with the fold (thicker end) leading.

Transport belt 45 is provided to ensure that shorter sheet products (DIN A5) can also be reliably conveyed until they come to rest against delimiter 19 or 20; for this purpose it can be swung up into the position indicated with dot-dash lines in FIG. 1, in which it prolongs deposition path 46 in operationally correct fashion.

When longer sheet products 40 (DIN A4) are to be deposited, transport belt 45 according to FIG. 1 then remains in a swung-aside position which does not interfere with the deposition procedure.

Figure 3:
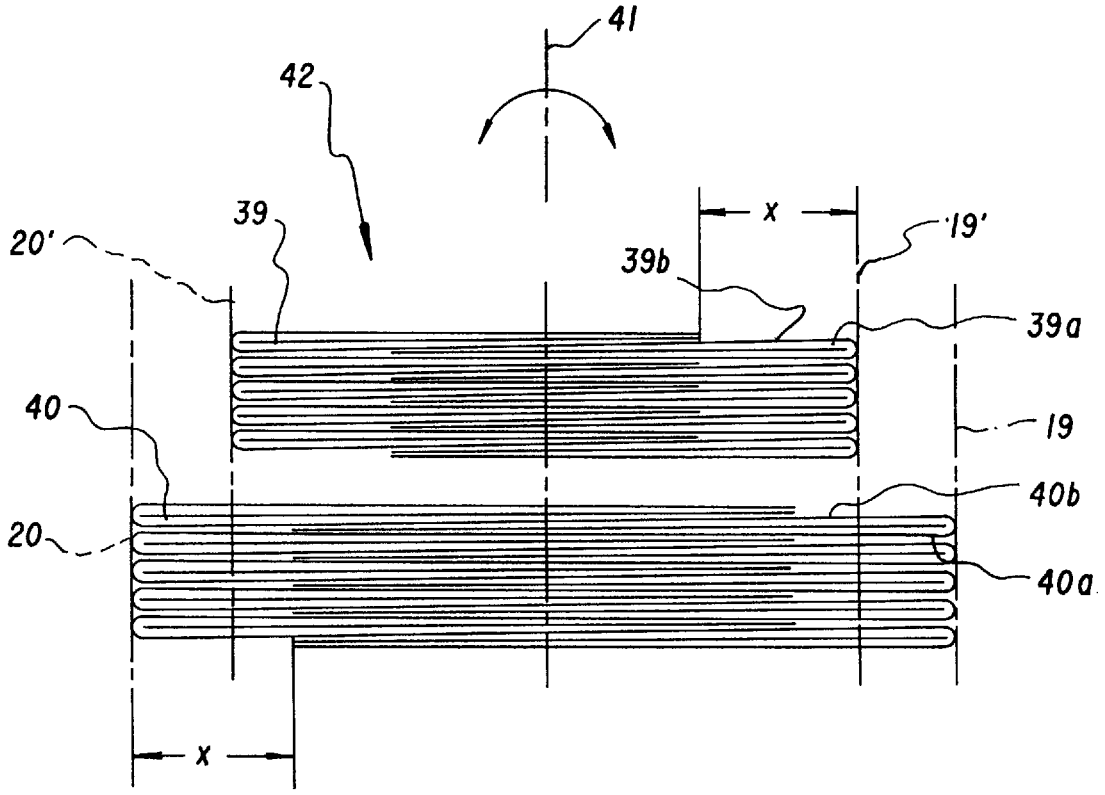
FIG. 3 shows a schematic depiction of a stack of sheet products of larger and smaller formats.

The apparatus operates as follows:

First the apparatus is adjusted to the format of sheet products 39 or 40 to be deposited, for example to DIN A4 as depicted in FIGS. 1 and 2. Referring to FIG. 3, in which two stacks 42 of different sizes (DIN A4 and DIN A5) are depicted schematically, the two delimiters 19 and 20 are set to a distance from rotation axis 41 which is greater than half the width (with respect to transport direction A) of sheet product 40 (DIN A4). As FIG. 3 shows, the result is that two superimposed sheet products 40 that are resting against delimiters 19 and 20 at their thicker end 40*a* (folded region), are deposited eccentrically offset from one another by an amount x with respect to rotation axis 41. The offset by the amount x can be adjusted as desired, and is selected so that at least the thickened folded region 40*a* remains uncovered in terms of sheet product 40 that is deposited next.

In the case of folded, multiple-page folded products joined by saddle stitching, especially of smaller format (DIN A4), which have a tendency to open by themselves after deposition, it is advantageous to offset by a greater amount x, as depicted in FIG. 3. The advantageous result of this feature is that the respective holding element 17, 33 or 18, 32 can be placed on sheet product 39, 40 in a region 39*b* or 40*b* located closer to rotation axis 41 and next to the thicker folded region 39*a*, 40*a*, so that the deposited folded product is reliably closed and held in the closed state. The folded product deposited next can thus be deposited without difficulty.

Adjustment to a different format, for example DIN A5, is accomplished by analogy with the aforesaid format adjustment.

Once the apparatus has been adjusted to the format of the sheet products to be deposited, the latter can enter the apparatus in the direction of arrow A. Transport belts 3 transport sheet product 40, with the thicker folded region 40*a* leading, to transport rollers 23, 43, which because of their oblique position depicted in FIG. 1 deflect sheet product 40 onto deposition path 46 and transport them in the direction of arrow B at an acute angle $\alpha$ toward delimiter 19. At the beginning of the deposition procedure, deposition table 34 is located in the top starting position depicted in FIG. 1, at the height of delimiters 19 and 20. Holding element 17, 33 occupies a raised position apparent from FIG. 1, in which it is located outside deposition path 46.

When sheet product 40 to be deposited is in contact with delimiter 19, its trailing end has left transport rollers 23, 43 and drops down onto deposition table 34. Holding element 17, 33 then swings into the deposition region and presses the deposited sheet product 40 against deposition table 34. Deposition tray 2 is then rotated by 120 degrees in a first direction. Holding element 17, 33 retains the deposited sheet product 40 during the rotation movement, and also after deposition tray 2 has reached its rotated position. The retaining position of the holding element is depicted in FIG. 1 for the opposing holding element 12, 32.

Once deposition tray 2 has reached its rotated position, the next sheet product 40 is deposited against delimiter 20, which is now positioned in deposition path 46, in the manner described above. When the next sheet product 40 has then been deposited, it is retained by the associated holding element, in this case by holding element 18 which is now arranged on the other side (this position is not depicted). Holding element 17 for the previously deposited sheet product is then raised, and pivoted out of deposition path 46. Deposition tray is now rotated by 180 degrees in a second, opposite direction. The deposited sheet products are retained by holding element 18 in the manner described.

The above-described presetting of delimiters 19 and 20, and alternate rotation of deposition tray 2 in opposite directions, result in the offset deposition of sheet products 40 apparent from FIG. 3.

A stable stack structure is achieved by the fact that sheet products 39 or 40 are deposited, in the manner described, offset by an amount x from one another. In addition, this type of offset deposition substantially increases the deposition capacity, since the stack height is determined exclusively by the number of sheets of sheet products 39 or 40 lying flat on top of one another. The thicker folded regions 39*a* or 40*a* on one side of stack 42 each lie, separated from one another and arranged above one another, at a spacing determined by the sheet product which lies between them and is deposited rotated with respect thereto, without being able to impair the stack height or the stability of the stack.

As the stack height grows, the angular position of holding elements 19, 33 and 20, 32, sensed by sensors, is determined, and when a defined limit value is exceeded, the lifting element is activated. The lifting element lowers deposition table 34 by a certain amount so that the top of stack 42 is always held at an operationally correct level. Holding elements 19, 33 and 20, 32 rest on stack 42 under spring preload.

Deposition tray 2 is alternately rotated in opposite directions so the supply lines to the apparatus can be easily implemented in the form of cables.

The deposition procedure continues until deposition table 34 has reached a bottom end position or a desired intermediate position, in which, for the purpose of removing sheet products 39 or 40, removal element 16 is rotated by a control element (not depicted) into a position (zero position) such that the supply lines to the apparatus (cables, et.) assume a position which does not interfere with removal element 16.

Deposition tray 2 is arranged behind a door (not depicted) arranged on the front of apparatus 1, which can be unlocked and then opened when the respective zero position is reached.

In the bottom end position or in a selected intermediate position, the deposited stack 42 or a partial stack of sheet products 40 or 39 can be removed. For this purpose, removal element 16 is pulled out of apparatus 1 to a removal position (indicated in FIG. 2 by dashed lines) by grasping the front handle 34*b*. IN the pulled-out position, deposition table 34 can be lifted off removal element 16, together with the stack of sheet products 42 located on it, by grasping the two handles 34*b* and 34*c*.

The apparatus can immediately be made ready for deposition again by putting an empty deposition table 34 in place and sliding in removal element 16. A control element (not depicted) of know type activates the lifting element, which transfers removal table 34 into its top starting position.

In a departure from the embodiment described, other sheet products, for example sheet stacks bound along one edge or adhesive-bound sheet stacks (not depicted), can also be stacked in the same advantageous manner.

When sheet products with a folded, stitched, or bound region that has only a slight thickening, for example a folded product that consists of only one folded sheet, are to be deposited, it is also possible to alternately rotate deposition tray 2 only after several sheet products have been deposited. This feature can increase deposition capacity if the sheet products, due to very short production times, enter deposition tray 2 in rapid succession.

In a departure from the embodiment depicted, the sheet products can also enter apparatus 1 at a different location above or below the position of transport belts 3 depicted in FIG. 1, or in the case of installation in a downline processing unit, can be introduced from the top of deposition tray 2 or can enter deposition tray 2 directly from folding or creasing rollers arranged in the region of transport rollers 23, 43 (not depicted).

The present invention was described with reference to a preferred embodiment, but modifications can of course be made by one skilled in the art, without departing the scope of the claims which follow.

We claim:

1. Apparatus (1) for stacking sheet products (39, 40) one above another, with a deposition tray (2) which is rotatable, for purposes of stack compensation, about a vertical axis (41), which has a vertically movable deposition table (34) and is equipped with two opposing vertically arranged delimiters (19, 20), associated with which are holding elements (17, 18; 32, 33) which retain the deposited stack (42) of sheet products during rotation of the deposition tray (2) and in which the sheet products are deposited with their thicker end (39*a*; 40*a*) adjacent to one of the opposing delimiters (19; 20), characterized in that:

said deposition tray (2) can rotate alternately by 180 degrees in such a way that in each case one of said opposing delimiters (19, 20) of said deposition tray (2) is arranged in the deposition path of the respective sheet product (39, 40), and serves as the stop surface for it;

the distance between said delimiters (19, 20) and the rotation axis (41) of said deposition tray (2), with respect to the transport direction (A) of the sheet products (39, 40) to be deposited, is greater than half the width dimension of the sheet product (39, 40), so that when said deposition tray (2) rotates alternately, the successively deposited sheet products (39, 40) are deposited offset from one another by an amount (x);

said holding elements (17, 18) are configured to be movable out of the deposition path (46) of the sheet products (39, 40), and can be placed alternately on the top of a deposited sheet product (39,40) or sheet stack (42); and said holding elements (17; 18) are associated with the region of the deposited sheet product (39; 40) adjacent to said respective delimiter (19; 20) that remains uncovered, due to the offset deposition (amount x), in terms of the sheet product (39; 40) to be deposited next.

2. Sheet Stacking Apparatus according to claim 1, characterized in that the amount (x) by which the sheet products (39, 40) are deposited offset from one another is at least as great as the thickened region (39*a*; 40*a*) in the bound, stitched, and/or folded region of the sheet product (39; 40).

3. Sheet Stacking Apparatus according to claim 1, characterized in that:

the amount (x) by which the sheet products (39; 40) are deposited offset from one another is greater than the thickened region (39*a*; 40*a*) in the bound, stitched, and/or folded region of the sheet product (39; 40); and that said holding elements (17, 18) can be placed on the sheet product (39, 39*a*; 40, 40*a*), inside the offset (x) remaining uncovered in terms of the sheet product (39; 40) to be deposited next, in a region (39*b*; 40*b*) lying closer to the rotation axis (41) and next to the greatest thickening (39*a*; 40*a*) of the bound, stitched, and/or folded region.

4. Sheet Stacking Apparatus according to claim 3, characterized in that said holding elements (17, 18) are configured as stationarily mounted pivotable levers which can be placed, from a position arranged outside the deposition path (43), on the top of the deposited stack (42) of sheet products (39; 40), and onto which an actuation element arranged outside the deposition region engages.

5. Sheet Stacking Apparatus according to claim 4, characterized in that two holding elements (18, 32 and 17, 33) are associated with each of said delimiters (17 and 18).

6. Sheet Stacking Apparatus according to claim 5, characterized in that said holding elements (18, 32 and 17, 33) are coupled to a control element to determine the vertical position of the top of sheet product stack (42).

7. Sheet Stacking Apparatus according to claim 6, characterized in that said opposing delimiters (19 and 20) and said holding elements (18, 32 and 17, 33) associated with them, as well as their actuation and control means, are each configured as assemblies (21 and 22) that can move jointly and can be adjusted in the transport direction (A) to different formats of the sheet products to be deposited.

8. Sheet Stacking Apparatus according to claim 7 characterized in that said delimiters (19, 20) and said holding elements (18, 32; 17, 33) are arranged above a deposition shaft (15) on the walls (7, 7*a* and 8, 8*a*) of said deposition tray (2).

9. Sheet Stacking Apparatus according to claim 8, characterized in that said vertically movable deposition table (34) is arranged below said delimiters (19, 20).

10. Sheet Stacking Apparatus according to claim 9, characterized in that said deposition table (34) is detachably mounted on a removal element (16) that can be pulled out in the manner of a drawer into a removal position.

11. Sheet Stacking Apparatus according to claim 10, characterized in that said deposition table (34) and said removal element (16) are movable from a deposition position arranged inside said apparatus (1) and used for deposition of the sheet products (39, 40) into a removal position that projects beyond the outside of said apparatus (1) and allows removal of the deposition table (34) and/or of the sheet products (39, 40).

12. Sheet Stacking Apparatus according to claim 11, characterized in that said removal element is guided in vertically movable fashion on motor-driven threaded spindles (9, 10, 30, 31); and that said threaded spindles (9,10, 30, 31) are driven simultaneously by a common drive.

13. Sheet Stacking Apparatus according to claim 12, characterized in that said threaded spindles (9, 10, 30, 31) are driven jointly via a tension means(35).

14. Sheet Stacking Apparatus according to claim 13, characterized in that arranged above said deposition tray (2) are transport, conveyance, and/or guidance means (3, 23, 43, 44, 45) which convey the sheet product (39; 40) to be deposited, on a deposition path (B) extending at an acute angle ($\alpha$), to said respective delimiter (19 or 20) of said deposition tray (2) serving as said stop.

15. Sheet Stacking Apparatus according to claim 14, characterized in that said transport, conveyance, and/or guidance means (3, 23, 43, 44, 45) are adjustable in the transport direction (A) or on the deposition path (B) to different formats of the sheet products (39, 400) to be deposited.

16. Sheet Stacking Apparatus according to claim 14, characterized in that said delimiters (19, 20) are adjustable in the transport direction (A) to different formats of the sheet products (39, 40) to be deposited.

17. Method for stacking sheet products (39, 40) one above another, with a deposition tray (2) that is rotatable, for purposes of stack compensation, about a vertical axis (41), that has a vertically movable deposition table (34) and is equipped with two opposing vertically arranged delimiters (19, 20), associated with which are holding elements (17, 18; 32, 33) which retain the deposited stack (42) of sheet products during rotation of the deposition tray (2) and in which the sheet products are deposited with their thicker end (39*a*: 40*a*) adjacent to one of the opposing delimiters (19; 20), characterized in that:

the delimiters (19, 20) of the deposition tray (2) are adjusted to a distance from the rotation axis (41) of the deposition tray (2) which is greater than half the width dimension of the sheet product (39; 40);

the sheet product (39; 40) to be deposited enters the deposition tray (2) on a deposition path (B) to the delimiters (19 or 20) extending at an acute angle ($\alpha$), and strikes with its thicker end (39*a*; 40*a*) against the delimiter (19 or 20) of the deposition tray (2) that is arranged in the deposition path and serves as a stop;

the deposition tray (2) is alternately rotated by 180 degrees so that the sheet products (39; 40) alternately striking one of the delimiters (19 or 20) are deposited offset by an amount (x) from one another; and after the respective deposition procedure, the associated holding element (17, 33; 18, 32) presses on the stack (42) in the region (39*b*; 40*b*) of the sheet product (39; 40) which remains uncovered by the amount (x) in terms of the sheet product (39; 40) to be deposited next.

18. Method according to claim 17, characterized in that the holding element (17, 33 or 18, 32) presses down the topmost sheet product (39; 40) or the sheet stack (42) until the next sheet product (39; 40) has been deposited and is acted upon by the holding element (18, 32 or 17, 33) associated with the next sheet product (39; 40).

19. Method according to claim 18, characterized in that the deposition tray (2) is moved in alternation in the opposite rotation direction after the deposition of one sheet product (39 or 40) in each case.

20. Method according to claim 18, characterized in that the deposition tray (2) is moved in alternation in the opposite rotation direction after the deposition of multiple sheet products (39 or 40) in each case.

21. Method according to claim 20, characterized in that the vertically movable deposition table (2) is controlled, as a function of the height of the sheet product stack (42), in such a way that the top of the stack (42) is arranged at a substantially unchanging deposition level.

* * * * *